US005738253A

United States Patent [19]

Diamond

[11] Patent Number: 5,738,253

[45] Date of Patent: Apr. 14, 1998

[54] PRESSURIZING THIN WALLED BARRIER CAN WITH MIXED PROPELLANTS

[75] Inventor: George B. Diamond, Glen Gardner, N.J.

[73] Assignee: Dispensing Containers Corporation, Glen Gardner, N.J.

[21] Appl. No.: 730,235

[22] Filed: Oct. 15, 1996

Related U.S. Application Data

[60] Provisional application No. 60/005,296 Oct. 16, 1995.

[51] Int. Cl.[6] ..... B67D 5/42

[52] U.S. Cl. ..... 222/389; 222/394

[58] Field of Search ..... 222/389, 394, 222/402.1, 192

[56] References Cited

U.S. PATENT DOCUMENTS

| | | | |
|---|---|---|---|
| Re. 30,093 | 9/1979 | Burger | 222/192 |
| 4,171,757 | 10/1979 | Diamond | 222/389 |
| 4,271,991 | 6/1981 | Diamond | 222/389 |
| 5,211,317 | 5/1993 | Diamond et al. | 222/394 |

*Primary Examiner*—Philippe Derakshani
*Attorney, Agent, or Firm*—Ostrolenk, Faber, Gerb & Soffen, LLP

[57] ABSTRACT

Forming a propellant mixture in a barrier-type fluent material dispensing can, wherein the mixture includes propellants of different volatilities and different evaporation rates so that the mixed propellant will have a lower equilibrium pressure at higher temperature than would be the equilibrium pressure of the original mixture before the more rapid evaporation of the one propellant.

6 Claims, No Drawings

PRESSURIZING THIN WALLED BARRIER CAN WITH MIXED PROPELLANTS

CROSS REFERENCE TO RELATED APPLICATION

This is based upon and claims rights from U.S. Provisional Application No. 60/005,296, filed Oct. 16, 1995.

BACKGROUND OF THE INVENTION

The present invention relates to a barrier-type, pressurized can for dispensing fluent and particularly viscous products. A barrier can has a movable piston, an evertible membrane or another separator between gaseous propellant in the pressure chamber at one side of the barrier and fluent material to be dispensed through the dispensing nozzle located at the other side of the barrier. Operating the dispensing nozzle dispenses the fluent material through the nozzle because the barrier is moved by gas pressure in the pressure chamber.

The propellant used in a barrier can for expelling the fluent material typically is a volatile liquid propellant. It can be a commercially available propellant, such as various proportions of fluorocarbons, hydrocarbons, hydroxycarbons, chlorinated and fluorinated solvents. A supply of a selected liquid propellant is deposited in the pressure chamber. The liquid propellant evaporates or boils off until its rated pressure, at the particular temperature then prevailing at the container, is achieved. So long as any of the unevaporated propellant liquid remains in the pressure chamber, as the pressure chamber enlarges with the expulsion of the fluent product and the shifting of the barrier, more of the propellant evaporates so that the pressure level is maintained at its equillibrium value. For example, a commercially available propellant called A31 will provide a pressure of 31 psig at 70° room temperature. However, at an elevated temperature of 130° F., the propellant pressure will increase, e.g. perhaps to as high as 97.3 psig.

In the prior art, air is typically used as the propellant in a barrier pack can or a single material propellant is used. Because of the thickness of the bottom and wall of a conventional can, there is usually no concern with the propellant pressure in the can at the various temperatures. This invention is concerned with thin walled and thin bottomed cans and particularly thin walled cans with a weak bottom.

The present invention is particularly for use in connection with some of the thin walled barrier cans shown in U.S. Pat. Nos. 4,171,757 and 4,271,991. A typical aerosol dispensing can or barrier can has sufficiently thick walls and bottom that elevated pressure in the can will not cause distortion or bursting of the can. But elevated pressure within the can can damage a very thin or weak wall and/or thin or weak bottom. The gas pressure provided by the propellant in the propellant chamber of a thin wall can must be controlled so that there is sufficient propellant pressure at an ambient temperature, typically room temperature, in the range of 50°–110° F. and particularly 70° F., to expel the entire fluent product content above the barrier at an acceptable rate. Yet the propellant must not produce such an elevated pressure, e.g. about 86 psig, at elevated temperatures, e.g. at 122° F. (50° C.) or 130° F. (55° C.) that the can will deform, which would violate government regulations for can strength. Some currently available inexpensive thin walled cans have a maximum 89 psig pressure tolerance.

With a thin walled, easily deformed barrier type can, where dispensing the fluent material contents requires that a particular pressure level be maintained in the pressure chamber of the can, e.g. 24 psig at room temperature, a propellant which at room temperature provides sufficient pressure in the pressure chamber, e.g. propellant A31 which provides 31 psig at room temperature, at an elevated temperature, like one that may be encountered by a can in storage on a hot day, e.g. 130° F., may have a pressure level, e.g. 97.3 psig, which is too high for the thin bottom of the can to resist and the thin bottomed and walled can may deform under the elevated pressure. On the other hand, a propellant which produces a low enough pressure level in the pressure chamber at the elevated temperature which pressure the can can resist, e.g. 89 psig, may at room temperature provide insufficient pressure to expel the entire contents of the can at an acceptable rate at room temperature, e.g. propellant A17 may provide 17 psig at room temperature, when at least 24 psig is required to expel the entire contents of the can.

One method of achieving the desired result is described in U.S. Pat. Nos. 4,171,757 and 4,271,991. The method described in these patents uses an amount and kind of propellant mixture that evaporates completely into the volume of the pressure chamber before any product has been expelled and before 130° F. (55° C.) has been reached. The maximum pressure will then be the pressure corresponding to the temperature at which full evaporation has taken place. The amount of propellant used is very critical and difficult to control in commercial operations, so that either excessive pressure or incomplete product expulsion (at an acceptable rate) occurs.

SUMMARY OF THE INVENTION

The objects of the invention are to enable the expulsion of the all the fluent material from a barrier can at room temperature, to be sure that there is sufficient liquid propellant for moving the barrier to fully expel all of the fluent material, to assure that when the barrier had moved to the full expulsion position, there had been still enough pressure in the container required to expel all of the fluent material and to assure that the pressure in the pressure chamber does not exceed a safe level for the particular thin walled and thin bottomed can when the can and the propellant have been heated, as on a hot day or at a required test temperature, and the propellant is under full pressure, e.g. before the barrier has shifted or even after the barrier has shifted but while there is still liquid propellant in the pressure chamber.

A particular object of the invention is to create a propellant mixture that can be used in the pressure chamber of a can so that the pressure at room temperature is in the usable range of 15–70 psig, depending on the viscosity or the desired flow rate of the fluent material. Room temperatures can be in the range of 50° F.–110° F. Further, the propellant mixture must be selected so that its pressure in the elevated temperature range of 130° F. (55° C.) or 122° F. (50° C.) does not distort the can, as required by various government regulations, that is with a thin walled and bottomed can, the pressure does not exceed 89 psig or other bottom strengths which vary in the range of 80–120 psig.

The invention comprises supplying a mixture of two or more different propellants, a first propellant that is more volatile and has a lower boiling point, and a second propellant that is less volatile and has a higher boiling point and possibly a third or more propellants and still other boiling points. They are mixed in proportions selected so that the quantity of the combined propellant in the pressure chamber will at room temperature provide sufficient pressure to expel the contents of the can and at an elevated temperature, e.g. 130° F., will be at a low enough pressure level in the pressure chamber due to faster evaporation of the more volatile component or components as to not deform or burst the thin walled can.

In one example, a mixture that is 30% of A31 propellant (31 psig at room temperature) and 70% of A17 propellant (17 psig at room temperature) provide a room temperature pressure that is sufficient to expel fluent material, e.g. 24 psig, but at 130° F., provides a safe, containable pressure of only 89 psig in the propellant chamber, rather than considerably more. When two propellants with different boiling points mix, the mixed propellant itself has a different evaporation rate and boiling point than each of the individual components. As the temperature is elevated above room temperature, the mixture evaporates so that some of both of the mixed propellants evaporates. But as the temperature rises, a greater proportion of the total volume of the more volatile lower boiling point propellant evaporates than of the less volatile higher boiling point propellant. As the temperature rises, the ratio of the propellants remaining in liquid form changes, with the proportion of the total remaining liquid form propellant of a lower boiling point becoming smaller. If, for example, the propellants are in the ratio of 30% high volatility low boiling point and 70% low volatility high boiling point at room temperature, then as the temperature elevates and both of the propellants evaporate, at an elevated temperature of 130° F., only 10% of the higher volatility propellant may remain in liquid form while the remaining mixed liquid propellant is of the lower volatility form. The resulting pressure now exerted by the remaining liquid propellant corresponds to a 10% high volatile mixture, rather than the previously 30% high volatile mixture. Once the propellant enters a gaseous phase, the gas pressure caused by the gaseous propellant is fixed and determined by the temperature in accordance with gas expansion laws and not by its original volatilities. There is a change in the rate of increase in pressure by more rapid boiling off of the higher volatility propellant so that the pressure in the pressure chamber increases more slowly with increased temperature. At a high temperature, the pressure has increased to a still safe level lower than would be the pressure if only the high volatility propellant were used, yet the pressure level is greater than is necessary to expel the fluent material and greater than if only a lower volatility propellant had been used. In addition to adjusting the proportions between the high and low volatility propellants, the total volume of propellant is selected in order that there be a desired total pressure range on the fluent material above the barrier throughout dispensing from the container.

Therefore, the propellants selected are mixed so that at room temperature, there is enough pressure to expel the fluent contents, and enough volume of liquid propellant so as to maintain the pressure range required to expel the fluent contents, yet a small enough volume of the liquid contents to allow pressure to develop beneath the barrier so that at the maximum temperature, a safe pressure level is maintained. For example, a mixed propellant is designed so as not to exceed 89 psig at 130° F., that is not to exceed the deformation strength of a very weak bottomed can, and it is used in sufficient quantity for achieving complete expulsion.

The propellant mixture and the amount of it used are such that the pressure at the required room temperature is in the range required to expel the product at a reasonably constant rate through the entire product contents. The mixture and the amount used are at the same time such that the lower boiling components (higher pressure components) evaporate in the pressure space before the barrier or piston has begun moving and before any product is discharged, so that the remaining liquid equilibrium pressure does not exceed the pressure which will distort the can at the required test temperature of 122° F. or 130° F. mandated by government regulations.

The propellant mixtures can be developed to comply with various flammability and volatile organic compounds regulations enabling compliance with various state and national standards while using minimal amounts of metal in the can and minimal amounts of propellants inside the can, providing maximum environmental benefits.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A propellant mixture for use in a barrier-type, pressurized can for dispensing fluent materials, wherein the barrier can includes a closed can having a dispensing nozzle, the barrier in the can is movable along the can toward the nozzle, the fluent material to be dispensed is in a fluent material chamber between the barrier and the nozzle, and the propellant mixture is in a propellant chamber in the can below the barrier; the propellant mixture comprising at least a first and a second propellant in the propellant chamber, the propellants being of such type and in sufficient respective quantities as to provide sufficient pressure at the ambient temperature to which the propellant chamber is exposed to supply sufficient pressure to the barrier to shift the barrier to urge the fluent material contents out through the nozzle;

the first propellant having higher volatility than and evaporating more rapidly at higher temperatures than the second propellant, so as to leave a mixture of propellants within the container having a lower equilibrium pressure at higher temperatures to which the propellant chamber is exposed than would be the equilibrium pressure of the original propellant mixture in the propellant chamber before the more rapid evaporation of the first propellant.

2. The propellant mixture of claim 1, wherein the first and second propellants are mixed in the propellant chamber of the can.

3. The propellant mixture of claim 2, wherein sufficient mixed propellant is supplied in the propellant chamber for achieving complete evacuation through the nozzle of the fluent material in the fluent material chamber of the can at ambient temperature at a predetermined satisfactory rate but below a predetermined rate.

4. The propellant mixture of claim 2, wherein the proportions of the first and second propellants are selected so that at normal ambient temperature of the propellant chamber, both propellants are in gaseous form and respective liquid forms of the propellant are also in the propellant chamber in a first ratio by volume, and so that at a higher temperature of the propellant chamber, the first and second propellants are at a second ratio by volume with a smaller proportion of the higher volatility propellant remaining in liquid form in the propellant chamber.

5. The propellant mixture of claim 4, wherein the ratio of first and second propellants and the total amount of propellants in the propellant chamber are selected so that before any of the fluent material is discharged through the nozzle, the remaining liquid equilibrium pressure in the propellant chamber does not exceed a pressure at higher temperatures that is greater than the pressure permitted by regulations regarding distortion of the can.

6. A propellant mixture for use in a barrier-type, pressurized can for dispensing fluent materials, wherein the mixture includes propellants of different volatilities and different evaporation rates so that the mixed propellant will have a lower equilibrium pressure at higher temperature than would be the equilibrium pressure than the original mixture after the more rapid evaporation of the one propellant.

* * * * *